US005368891A

United States Patent [19]

Sagara et al.

[11] Patent Number: 5,368,891

[45] Date of Patent: Nov. 29, 1994

[54] METHOD AND APPARATUS FOR PRODUCING GLOSSY PRINTED MATTER

[75] Inventors: Toshiharu Sagara, Saitama; Toshikatsu Funahara, Chiba; Takakazu Nakatani, Saitama; Mitsuru Kojima, Chiba, all of Japan

[73] Assignee: Sakata Inkusu Kabushikikaisha, Osaka, Japan

[21] Appl. No.: 88,086

[22] Filed: Jul. 7, 1993

Related U.S. Application Data

[63] Continuation of Ser. No. 707,208, May 23, 1991, abandoned.

[30] Foreign Application Priority Data

May 26, 1988 [JP] Japan ..... 63-129696
Jul. 13, 1988 [JP] Japan ..... 63-175353

[51] Int. Cl.[5] ..... B44D 5/00; B05D 3/00; B31F 1/20

[52] U.S. Cl. ..... 427/258; 427/362; 427/366; 427/374.1; 427/391; 427/411; 156/205; 156/470

[58] Field of Search ..... 100/93 RP, 38, 173, 100/174; 118/117, 67, 101, 46; 156/205, 207, 210, 552, 470; 162/206; 427/361, 362, 365, 366, 391, 411, 398.1

[56] References Cited

U.S. PATENT DOCUMENTS

| | | | |
|---|---|---|---|
| 3,567,554 | 3/1971 | Klein et al. | 156/552 X |
| 3,632,367 | 1/1972 | Brown et al. | 427/288 X |
| 3,853,594 | 12/1974 | Moroff et al. | 427/361 X |
| 3,963,820 | 6/1976 | Blakey | 427/365 X |
| 4,277,524 | 7/1981 | Nakajima et al. | 118/69 X |
| 4,500,381 | 2/1985 | Nordstrom | 156/205 |
| 4,653,395 | 3/1987 | Verkasalo | 100/93 RP |
| 4,738,197 | 4/1988 | Mälkiä | 100/93 RP |
| 4,841,903 | 6/1989 | Bird | 118/46 |

*Primary Examiner*—Thi Dang
*Attorney, Agent, or Firm*—Fitch, Even, Tabin & Flannery

[57] ABSTRACT

Disclosed is a method and an apparatus for efficiently and economically producing printed matter having a high degree of gloss, rub-resistance, water-resistance and resistance to contamination. In this method and apparatus, a web-fed printed matter or a web-fed printing paper is coated with a coating agent for roll press working and subjected to hot roll press working while in the state of a web.

5 Claims, 3 Drawing Sheets

METHOD AND APPARATUS FOR PRODUCING GLOSSY PRINTED MATTER

This is a continuation, of application Serial No. 07/707,208, filed May 23, 1991, now abandoned.

BACKGROUND OF THE INVENTION

1. Field of the Invention

This invention relates to a method and an apparatus for producing glossy printed matter. More particularly, it relates to such a method and apparatus wherein a web-fed printing paper or printed matter is coated with a coating agent for roll press working and subject to hot roll press working while in the state of a web.

2. Description of Prior Art

High gloss and resistance are freqeuntly required of printed matter from the viewpoints of high quality and finely decorative appearance.

For example, when printed matter is employed for a packaging container, such as a carton for a gift, there is a need to accentuate the impression that the contents, such as an electrical appliance or detergent, are of high quality. The printed matter used for this purpose is therefore required to possess a high degree of gloss, rub-resistance, water-resistance and resistance to contamination. The same characteristics are also required of posters, calendars, the cover pages of books and shopping bags.

Heretofore, in producing printed matter having a high gloss, papers having excellent smoothness, such as a cast-coated paper, have been employed. Such a cast-coated paper is obtained by coating paper supplied by a paper manufacturer, with a coating agent containing a large amount of clay, and contacting the coated layer with the cast surface of a drum plated with chromium. Since this cast-coated paper contains a large amount of clay, it is heavy and hard, lacking in folding endurance. Moreover, it has poor water resistance and inferior rub-resistance, because it is intended to be employed in printing following the casting operation.

Consequently, the gloss-bearing surface of the cast-coated paper itself is effective in the printing, but the gloss of the printed area is thereby lowered and said resistances of the finished printed matter are insufficient. In order to obtain higher resistance, it is necessary to perform a post-processing, such as over-varnishing. This however, leads to a loss of cost-effectiveness because of the cost of the cast-coated paper itself and the necessity to perform post-processing.

Consequently, it is necessary to provide a coating of so-called over-varnishes or laminating a plastic film over the printed matter, this being the conventional means of providing gloss for the printed product.

The method of applying over-varnishes, while being effective to a limited extent in improving the gloss, is not able to fully meet the high demand in the market for glossy products of high quality and a finely decorative appearance.

The so-called UV curable over-varnishes, in which UV rays are employed as the drying means, exhibits excellent gloss characteristics but is unsatisfactory in providing a mirror surface finish and assumes a hard film upon curing, as well as low folding endurance. Moreover, this method presents problems in cost terms since a special drying device is necessitated and the UV varnish itself is expensive.

In regard to the latter method, although a high gloss may be obtained due to the use of the plastic film, the final product lacks satisfactory transparency due to non-uniform coating of the adhesive employed in bonding the film to the paper, so its quality is poor. This method is also unsatisfactory from the equipment and cost viewpoints.

Another known technique is to apply a resin solution on the printed matter and to apply, after drying, a direct pressure press or an endless pressure press using stainless belt (so-called endless press) with the aid of a mirror surface of the belt. A high gloss can be obtained by the technique since the resin film which is dried after application is heat-melted and smoothed by the mirror surface, but the direct presssure press method does not lend itself to high productivity because the press working has to be performed individually for each sheet. While the endless press method offers improved productivity as compared with the direct pressure press method because it is formed of endless belt of, for example, stainless steel, and is adapted to allow continuous insertion of printed sheets, one by one, the latter needs to be peeled manually off the belt surface, because the peeling or release action is based on the stiffness of the sheet itself. This method cannot be employed with sheets having a weight of up to 100 g/m$^2$, since the peeling or release action cannot then be achieved smoothly, even when the paper sheet itself is endowed with a certain degree of stiffness.

In the field of corrugated boards, the demand for high quality or finely decorative products is increasing, and the corrugated boards having high gloss is rapidly rising. In producing corrugated boards having high gloss, an over-coating agent is applied at the stage of, for example, the last printing unit of the printing press in a corrugated board printer or alternatively the printed corrugated boards are coated with vinyl resin solution to impart a final gloss to the finished boards. This method of applying over-varnishes, while being effective to a limited extent in improving the gloss, however, is not able to fully meet the high demand in the market for glossy products. On the other hand, above said press working method cannot be applied to corrugated boards obtained after bonding front and back liners and a core liner, since there would be a risk of the corrugations collapsing due to the pressure. Therefore, if a corrugated board having such high gloss is to be obtained, it is necessary to initially produce a press worked printed sheet, and after then, to bond it a corrugated board. This necessitates a special bonding machine, and productivity is extremely low because the sheets need to be bonded one by one after being brought into registration with each other.

SUMMARY OF THE INVENTION

It is an object of the invention to provide a method of efficiently and economically producing printed matter having a high degree of gloss, rub-resistance, water-resistance and resistance to contamination.

It is another object of the invention to provide a method of efficiently and economically producing a printed corrugated board having high gloss and improved resistance.

It is a further object of the invention to provide an apparatus for continuously and efficiently producing printed matter having high gloss and improved resistance.

Other objects and advantages of the present invention may become apparent to those skilled in the art from the following description and figures.

DESCRIPTION OF THE PREFERRED EMBODIMENTS

Figure 1:
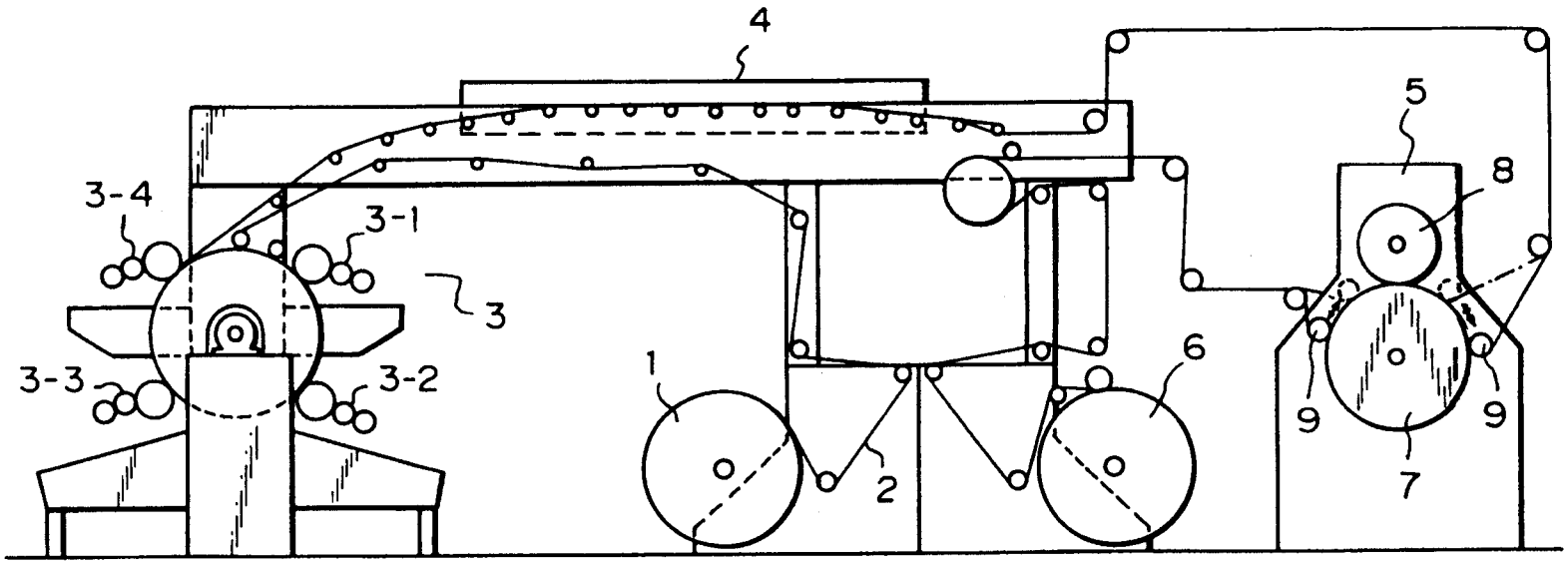
FIG. 1 is a diagrammatic view showing essential portions of an apparatus suitable for the manufacture of printed matter having high gloss and improved resistance pertaining to the present invention.

The method for producing the glossy printed matter pertaining to the present invention will be explained in more detail.

Suitable printing materials that may be employed in practicing the present invention include coat board paper, K-liner, jute liner, art paper, coat paper and machine glazed paper.

Although there is no limitation as to the quality or thickness of the paper, it is preferred that paper having a specific weight of not more than 100 g/m$^2$ be used since such paper is superior in dimensional stability, with respect to the heat employed for roll press working, surface smoothness and homogeneity.

For printing on these paper papers, any of the conventional printing methods may be employed, such as offset, gravure or flexographic printing. However, the printing method is limited to those in which the printing is performed on a printing material in the web state. The printing ink may be of the oil-based, solvent-based or water-based types in accordance with the particular printing method employed.

The printed matter obtained by offset (web-offset) printing, gravure printing or flexographic printing is coated with a coating agent for roll press working after the completion of the printing process.

As for the coating of the coating agent for roll press working, the coating agent for roll press working as recited hereinbelow is applied to the web-fed printed matter on which printing has been performed, as described above, by relying upon one of various methods, such as roll coating, air knife coating, curtain coating or spray coating. Gravure printing or flexographic printing machines may also be employed as coating means. In this coating process, the coated agent is dried and taken up when the coating process is performed independently of the printing process. However, the coating may be performed as a continuation of the printing process depending on the type of printer used in the printing process and associated devices. For example, when there is a redundant printing unit not being used for printing in a multicolor gravure or flexographic printing press, they may be used in the coating machine for roll press working coating agents, whereby printing and coating may be performed continuously. In a web-offset printing press, a coating device connected in the processing line thereof may be used for the coating.

A variety of conventional coating agents for press working that are employed in press working methods for direct press working or press working methods employing endless belts may be utilized as the coating agent for the roll press working applied to the printed matter. However, water-based type coating agents are most preferred from the viewpoint of minimizing fire risk. As regards the solvent-based type, a resin solution of a vinyl chloride/vinyl acetate type resin may be employed. As for the water-based type, a coating agent composition consisting essentially of an aqueous resin dispersion having a glass transition temperature (Tg) ranging from 60° to 130° C. may be employed.

The aqueous resin dispersion with a specific glass transition temperature employed in the aqueous coating agent for roll press working may be obtained by setting the ratio of polymerization of each vinyl monomer, recited hereinbelow, on the basis of the well-known approximate formula, taking account of the glass transition temperature of the homopolymer of the vinyl monomers. An aqueous resin dispersion having the targeted glass transition temperature Tg may also be obtained from a so-called polymer blend which is a mixture of an aqueous resin dispersion consisting of a polymer with a higher Tg and a polymer with a lower Tg. The following vinyl monomers may be employed for preparing the aqueous resin dispersion pertaining to the present invention.

Vinyl monomers which will give a homopolymer with a higher Tg include, for example, acrylic vinyl monomers, such as acrylic acid, methacrylic acid, methyl methacrylate or ethyl methacrylate, and styrenic vinyl monomers such as styrene or $\alpha$-methyl styrene. Vinyl monomers with a lower Tg include, for example, alkyl esters of acrylic acid or methacrylic acid apart from the above methyl or ethyl methacrylate, alkyl esters having straight-chain or having side chain, such as methyl, ethyl, propyl, isopropyl, n-butyl, s-butyl, t-butyl, hexyl, 2-ethyl hexyl, decyl or lauryl. Vinyl monomers other than the above monomers may also be copolymerized, such as alkyl esters of unsaturated monocarboxylic acids, for example, crotonic acid, $\alpha$, $\beta$-unsaturated dicarboxylic acids, for example, itaconic acid, fumaric acid or maleic acid, amide derivatives of acrylic acid containing at least one N-substituted methylol group, such as N-methylol acrylamide or N-butoxymethyl acryl amide, mono- or diesters of acrylic or methacrylic acid of glycols such as ethylene glycol, diethylene glycol, propylene glycol or dipropylene glycol, monomers of glycidyl ethers of acrylic or methacrylic acid, acrylonitrile, vinyl chloride, vinyl acetate, vinyl propionate or vinylidene chloride. Of these vinyl monomers, those consisting essentially of acrylic acid, methacrylic acid or alkyl esters thereof, or styrenic vinyl monomers, are most preferred.

In order to obtain an aqueous resin dispersion from these vinyl monomers, it suffices to perform an emulsion polymerization of the monomers by a well-known method to produce a stable dispersion using hydrophilic catalysts, such as ammonium persulfate, potassium persulfate or aqueous hydrogen peroxide, or Redox catalysts. An emulsifying agent may be employed, if desired.

A mixture of vinyl monomers may be copolymerized in the emulsified state in the presence of anionic or nonionic surfactants to provide an emulsifying agent. In general, the use of low molecular weight surfactants occasionally affects the water-resistance of the coating formed, so that high molecular weight anionic surfactants are most preferred as emulsifying agents in cases where water-resistance is required.

The aqueous resin dispersion employed in the present invention will exhibit superior properties if such emulsifying agents are utilized. These high molecular weight emulsifying agents may be exemplified by aqueous solutions of conventional alkali-soluble resins, such as Shellac, acrylic or methacrylic or malic copolymers containing carboxylic groups.

As far the coating composition for roll press working employed in the present invention, it is necessary to employ an aqueous resin dispersion having a higher glass transition temperature of 60° to 130° C. For this reason, it is preferred, at the time of emulsification polymerization which, as shown in the Examples, is obtained by emulsification polymerization of said vinyl monomers, using a larger amount of an aqueous solution of alkali-soluble resins constituted by vinyl monomers forming a homopolymer having a higher glass temperature, such as acrylic acid, methacylic acid methyl methacrylate, ethyl methacrylate or styrene, as a emulsifying agent.

The alkalis employed for solubilizing in water the alkali-soluble resins may include ammonia or organic amines, such as triethanol amine or monoethanol amine. Highly volatile alkalis are most preferred from the viewpoint of facilitating drying of the water-soluble resins.

With the glass transition temperature of the aqueous resin dispersion being lower than 60° C., a reduction in glossiness or blocking will result. With a Tg higher than 130° C., the collapsibility of the coating film is insufficient at the time of roll press working, so that the desired degree of high gloss cannot be achieved. The "high gloss" referred to herein corresponds to an incident angle of 60° and a mirror surface glossiness of not less than 70, while "ultra high gloss" corresponds to a mirror surface glossiness of not less than 80.

The composition of the coating agent may occasionally be supplemented by additives, such as water-soluble varnishes for augmenting the adhesive properties relative to the printing surface. Thus the composition may have aqueous solutions of alkali-soluble resins, such as Shellac, acrylic, methacrylic or malic resins added to it.

Further, polyethylene waxes for improving the resistance to rub, higher fatty acids, such as stearic acid, higher alcohol, such as cetyl alcohol, or surfactants, such as phosphates, for improving the peeling properties at time of press working, may be employed.

Urethane, epoxy, aziridine, metal cross-linking agents or the like may also be employed as additives for improving the rub-resistance, water-resistance, thermal resistance and resistance to chemicals.

Coloring agents, such as dyes, pigments or the like, or extender pigments may also be added as additives, whereby colored and glossy products are obtained if it is necessary.

A central core liner and a back liner were bonded together by means of a corrugating machine with a front liner coated with a conventional coating agent for roll press working. It was found that such coated film on a corrugated sheet will be re-softened at a bonding temperature of 160° to 190° C. and the gloss will thus deteriorate, or the re-softened resin will undergo hot-plate or corrugated sheet contamination which will lead to a lowering of the commercial value of the printed products.

Thus the conventional coating agent for press working per se cannot withstand the elevated temperatures involved with corrugated machines.

As a countermeasure, use of a resin having a higher softening point as the resin for the coating agent might be contemplated as a way of improving the thermal resistance thereof in a corrugating machine. However, not only does the roll press temperature need to be elevated correspondingly, but paper shrinkage may also occur due to the higher temperatures involved in roll press working, and this may in turn lead to misalignment of corrugated sheets during paper cutting, deterioration in paper strength or warping or curling of the sheets, resulting in disadvantages in the manufacture of corrugated boards.

In the practice of the present invention, it is necessary to employ a coating agent including inorganic fillers mentioned below, which allows high gloss to be imparted, does not present problems such as lowered gloss quality when subjected to adverse operating conditions such as high temperatures, friction or contact with hot plates such as those encountered during the bonding step, and which is suited for the preparation of corrugated boards.

Said inorganic fillers that may be employed in cases where a higher thermal resistance is required include silica powders, silica gel, quartz powders, alumina, glass powders, talc, clay, calcium carbonate, magnesium carbonate, zinc flower or barium sulfate, and should be contained in the coating agent of the present invention in an amount of not more than 5.0 wt. %, preferably in the range of 0.5 to 3.0 wt. %. If the content of the inorganic filler exceeds 5.0 wt. %, printed matter of high gloss cannot be obtained.

Production of the coating composition for roll press working is achieved either by mixing an inorganic filler into the aforementioned aqueous resin dispersion or employing the conventional dispersing device to effect grinding and dispersing.

The coating agents for roll pressing working containing the aforementioned ingredients may be applied on all or only certain intended portions of a web-fed printed matter obtained by flexo ink, offset ink or gravure ink using the above described printing means.

The web-fed printed matter may be coated in an independent coating step or as a continuation of the printing process already described or the roll press working process to be described later.

The web-fed printed matter coated with the coating composition for roll press working is dried if necessary and gloss is imparted thereto by a hot roll employed for roll press working.

The words "roll press working" to be used in this specification shall mean the pressing process undertaken under a specific evaluated temperature and specific pressure, by bringing a printed matter or printing paper coated with a coating agent for said pressing in the web state into intimate contact with a hot roll machined to a mirror finish.

The hot roll temperature may be in the range of from 90° to 190° C. and the pressure between the hot roll and the pressure roll may be in the range of from 60 to 150 kg in terms of linear pressure.

In the practice of the present invention, a hot roll press having a hot roll and a pressure roll as a pair of rolls or a hot roll press having two or more pairs of hot rolls and press rolls connected in tandem may be employed. The roll press working process may be carried out as a continuation of the process of applying a coating for roll press working or may be carried out as an independent process.

The respective process explained above may be performed separately or part or all of the processes may be carried out continuously for efficient production of printed matter having high gloss.

Reference will now be made to the accompanying drawings in explaining an apparatus suitable for practicing the method of producing glossy printed matter in accordance with the present invention.

FIG. 1 is a diagrammatic view showing portions of an apparatus suitable for producing glossy printed matter in accordance with the present invention. In FIG. 1, the numeral 1 denotes a mill roll stand for web-fed printable matter 2. The printable matter 2 reeled out from the roll stand is coated with a coating agent for roll press working in a coating and printing unit 3.

The left side of FIG. 1 illustrates a flexo printing press of the central impression drum type. A printing unit not used for printing, such as the unit 3-4 shown in FIG. 1, may be used as the coating device.

The numeral 4 denotes a drying unit that is installed when needed. The web-fed printed matter coated with the coating agent is provided with a gloss in a roll press unit 5, as illustrated at the right side of FIG. 1. The roll press unit 5 is mainly composed of a hot roll 7 machined to a mirror finish and a pressure roll 8. The web-fed printed matter coated with the coating agent is brought into intimate or tightly contact at a temperature of 90° to 150° C. at a linear pressure of 60 to 150 kg/cm$^2$ and imparted in this manner with the luster or gloss required. A guide roll 9 is used for adjusting the contact width of the web-fed printed matter with respect to the hot roll. The width of contact with the hot roll is adjusted in accordance with the weight of the paper used and the glass transition temperature of the resin used in the coating agent employed for roll press working so as to help melt the coating agent to achieve sufficient smoothness thereof on the mirror surface.

After roll press working, the printed matter is taken up on a take-up roll 6. The printed matter then undergoes punching, box-making, pouch-making or other processing operations.

In the case of using the apparatus of FIG. 1, printing, coating or roll press working may be performed continuously by setting the paper on the roll stand, performing flexographic printing at the printing units 3-1 to 3-3 of the flexo printing press shown as a printing device, and performing coating of the coating agent for roll press working in the printing unit 3-4.

Figure 2:
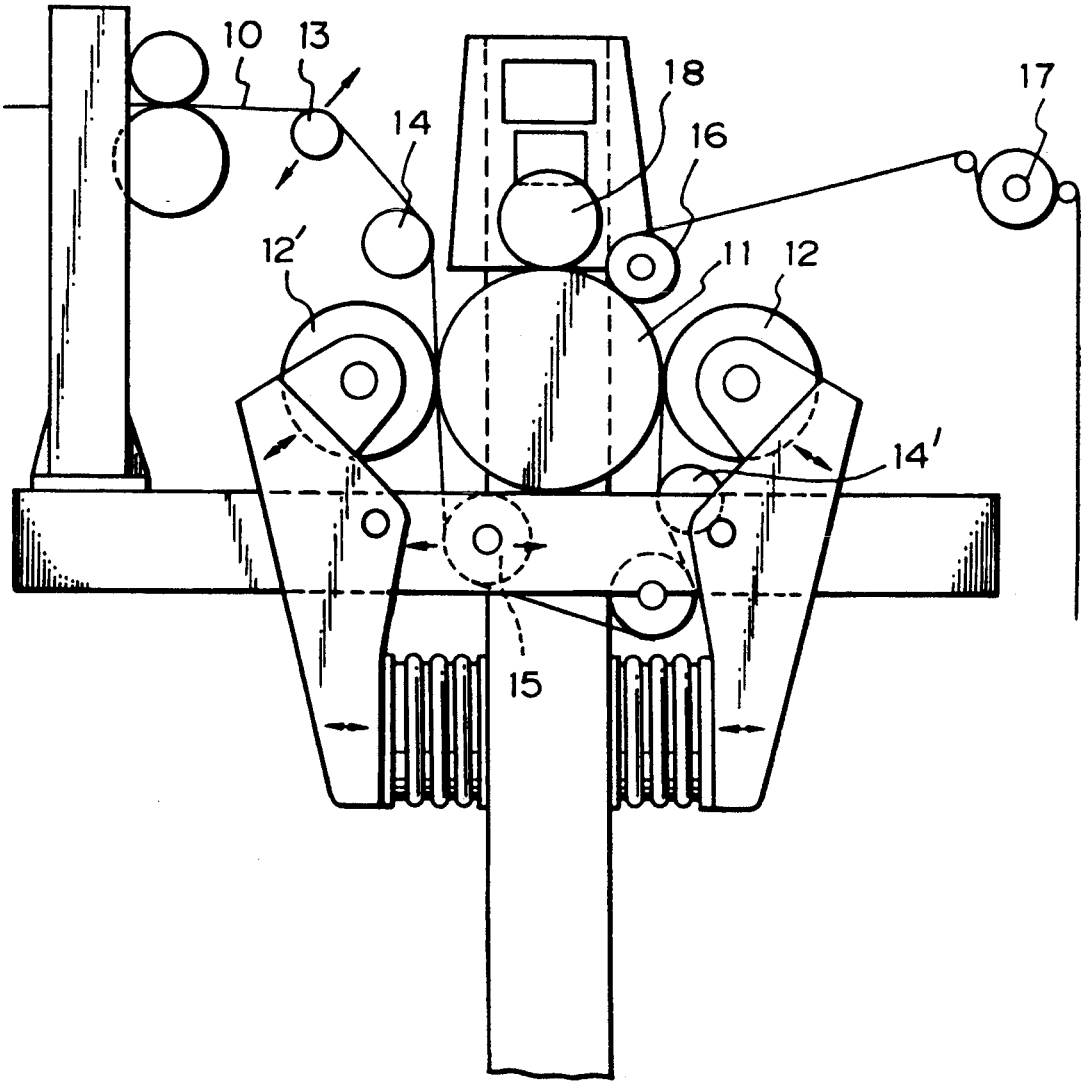
FIG. 2 is a diagrammatic view showing other essential portions of a roll press working unit pertaining to the present invention.

FIG. 2 is a diagrammatic view showing other essential portions of a roll press working unit of an apparatus suitable for producing glossy printed matter. FIG. 2 illustrates a practical embodiment of a roll which facilitates peeling from the hot roll after roll press working, web tension adjustment and prevention of creases. Two pressure rolls are provided to raise the efficiency of press working.

FIG. 2 illustrates a web-fed printed matter or printing paper 10 on which a coating agent for roll press working is applied. The numeral 11 denotes a hot roll machined to a mirror finish and the numerals 12, 12' denote pressure rolls of heat-resistant rubber brought into tight contact with the hot roll at a linear pressure of 60 to 150 kg/cm. The web-fed printed matter 10 coated with a coating agent for roll press working is adjusted to a suitable tension by a guide roll 13 fitted with a tension adjustment unit, and is transported to the hot roll so as to be pressed by the mirror surface as the transverse elongation of the web is corrected, creasing being prevented by an arched expanding roll 14. After completion of the pressing performed by one of the pressure rolls 12', the web is pressed by the other pressure roll 12 onto the hot roll 11, after the elongation is absorbed by a dancing roll 15 and the transverse elongation is corrected by the arched expanding roll 14'. After press working, the web is passed by the peeling roll 16, peeled from the hot roll and cooled by the cooling roll 17 so as to be taken up or transported to the next processing station. The numeral 18 denotes a cleaning device for hot roll 11. By employing a combination of the various rolls described above, printed matter with high gloss may be obtained without any creasing.

An explanation will now be given of a method of producing glossy printed matter pertaining to the present invention as applied to the manufacture of carton boxes.

The front liner, inter core and back liner are bonded together by a conventional corrugating machine. In the practice of the present invention. When a front liner printed is employed, the liner wound on a roll is installed in a front liner mill roll stand, and a coating agent for press working is applied by means of a coater provided ahead of a front liner preheater. The front liner is dried by the preheater, pressed by a roll press provided ahead of a double facer and bonded to the inter core and the back liner. If the front liner has already been coated with the coating agent for roll press working, the coater may be dispensed with. If the front liner has already been roll press worked, bonding may be performed on a conventional corrugating machine without a coater or roll press.

It will be noted that, in the practice of the method of the present invention, unprinted corrugated boards are produced in rare case, since already printed front liners are bonded to the other members. Thus, when non-continuous printing is performed on each portion of a carton, it is necessary to provide a cutting device for cutting according to the printed pattern. The final carton box may be obtained by performing cutting as desired.

An apparatus suitable for practicing the method of producing glossy corrugated boards will be explained by referring to the drawings.

Figure 3:
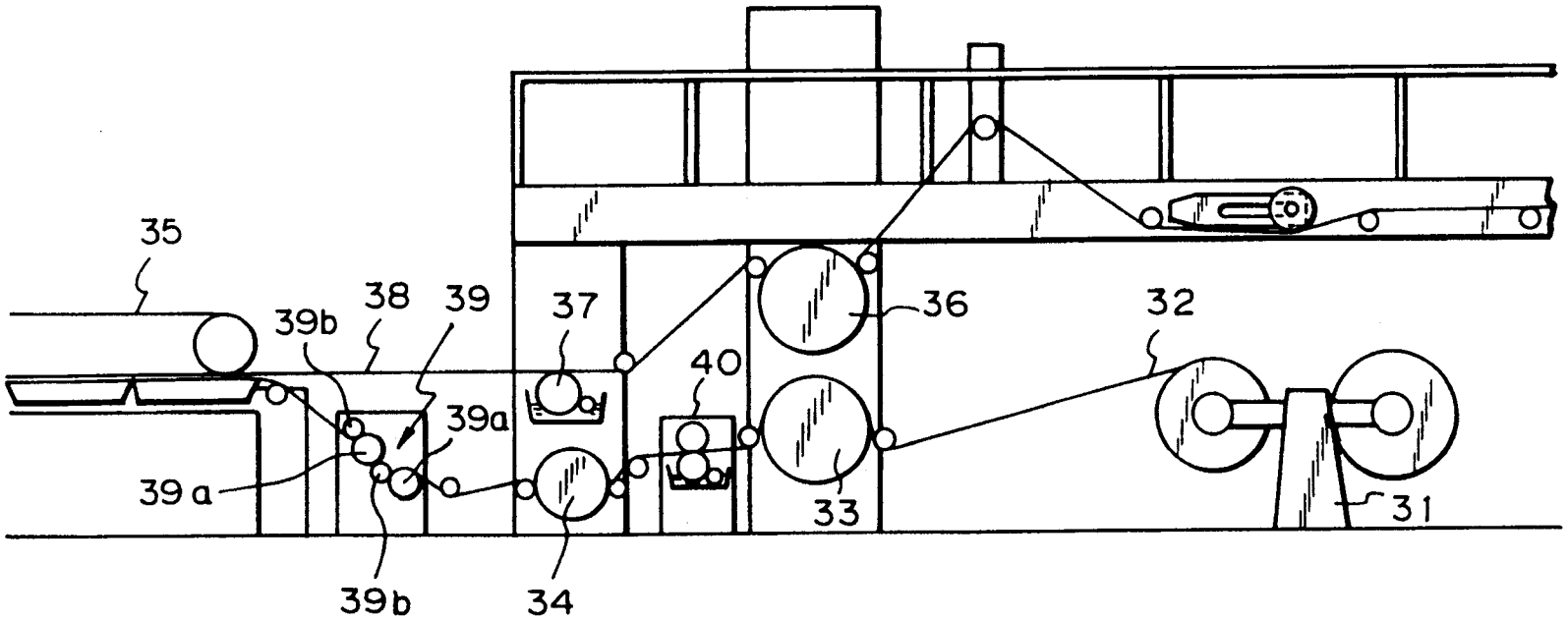
FIG. 3 is a diagrammatic view showing essential portions of an apparatus suitable for the manufacture of corrugated boards having high gloss and improved resistance pertaining to the present invention.

FIG. 3 is a diagrammatic view showing essential portions of an apparatus suitable for producing glossy corrugated board in accordance with the present invention, and illustrates a case in which coating of the coating agent for roll press working and roll press working are performed continuously in a corrugating machine.

In FIG. 3, numeral 31 denotes a mill roll stand for a front liner. In the customary method of manufacturing corrugated boards, the unprinted front liner reeled out from this mill roll stand is heated by a preheater 33 in a double or triple heater and a preheater 34 for the front liner. The liner is conveyed to a double facer 35, reeled out at this time from the single facer and heated by a preheater 36 for single-faced corrugated board. An adhesive is applied to the top of the corrugations (flute top) of the core and the single-side corrugated board 38 conveyed to the double facer 35 is bonded to the liner to provide a double-faced corrugated board. These single-sided corrugated boards and dual double-sided corrugated boards may be produced by methods well-known in the art.

A device for practicing the method of the present invention will now be explained in connection with double-sided corrugated boards.

In the device for producing glossy corrugated boards according to the present invention, a roll press working unit 39 is provided between the preheater 34 and the double racer and includes a heat roll machined to a mirror finish for imparting gloss to the front liner coated with the coating agent for roll press working.

Also provided between the preheater 33 and the preheater 34 is a coater 40 incorporating a roll coater for applying a coating agent for roll press working.

The coater 40 may also be provided between the preheater 33 and the mill roll stand 31 for the front liner.

A web roll of a front liner printed by the rotary press by a printing process such as gravure printing is taken up and is installed in a mill roll stand 31 on this mill roll. The preprinted front liner reeled out from the mill roll may be coated on all or certain intended portions of the liner by utilizing a coater 40 installed between the mill roll stand 31 and the preheater 33 or between the preheater 33 and the preheater 34. The coater volume is preferably up to 30 g/m$^2$ if a high degree of gloss is desired.

The coating agent applied by the coater 40 needs to be dried before arriving at the roll press working unit 39. If the preheater 34 alone is insufficient, the coater 40 is preferably provided ahead of the preheater 33.

The front liner is conveyed to the roll press working unit 39 installed between the preheater 34 and the double facer 35 after the coating agent for roll press working applied to the preprinted front liner has dried. The front liner is passed between a hot roll 39*a* which is a hard roll subjected to mirror finishing and which is heated to 90 to 130 C. and a pressure roll 39*b* such as a paper-coated roll. During this process, the coating agent for press working is softened, while the required gloss is imparted by bringing the surface of the mirror finished hot roll into contact with the surface of the front liner under a pressure of ca. 60–150 kg/cm applied between the hot roll 39*a* and the pressure roll 39*b*. In the present invention, since the front liner which forms part of a corrugated board corresponds to a thickness as cardboard, it is optionally necessary to provide two or more pairs of the above-mentioned rolls. The number of roll pairs is desirably determined after considering the spacing for the roll pressing working unit of existing corrugating machines.

It is possible to raise or lower the speed or degree of slippage at the contacting portions of the roll pairs so that a higher degree of gloss can be imparted by changing the press roll diameters of the pair of rolls.

When using the above-described corrugating machine, it suffices to attach a so-called pre-printed front liner to the mill roll stand for front liners, thereby allowing printed corrugated boards having high gloss to be produced efficiently.

The coater may be omitted when a preprinted front liner is used and is coated with the coating agent for roll press working and taken up in that state.

A front liner may be preprinted by a rotary printing press including multi-color printing units and it is easy to use one of printing unit as a coater for coating agent, so that application of the coating agents for press working does not necessitate provision of a new coater. This improves cost efficiency. The manufacture of glossy 10 corrugated board may be achieved by newly providing a roll press working unit within a corrugating machine. The position of the roll press working unit within the corrugating machine may be at any arbitrary point between the front liner mill roll stand and the double facer. However, from the viewpoint of such factors as heating of the front liner, it may suitably be provided between the double or triple preheater and the preheater for the front liner.

EXAMPLES

Example 1

Preparation of Dispersion A

Using an aqueous alkaline solution of an alkali-soluble resin consisting of 53 wt. % of methacrylic acid, 23 wt. % of methyl methacrylate and 24 wt. % of styrene as the emulsifying agent, 34 parts by weight of styrene were added to 66 parts by weight of the resin contents of the dispersant and the mixture was subjected to emulsion polymerization in the conventional manner to produce an aqueous resin dispersion A. The dispersion A so produced had a solid content of 37 wt. % and a glass transition temperature of ca. 125° C.

Example 2

Preparation of Dispersion B

Using an aqueous alkaline solution of an alkali-soluble resin consisting of 28 wt. % of methacrylic acid, 4 wt. % of methyl methacrylate, 7 wt. % of methacrylate and 61 wt. % of ethyl acrylate as the emulsifying agent, 88 parts by weight of styrene were added to 12 parts by weight of the resin contents of the dispersant and the mixture was subjected to emulsion polymerization in the conventional manner to produce an aqueous resin dispersion B. The dispersion B so produced had a solid content of 55 wt. % and a glass transition temperature of ca. 89° C.

Example 3

Preparation of Dispersion C

Using an acrylic resin (Johncryl 67) as the alkali-soluble resin, an aqueous alkaline solution thereof was used as the dispersant. 54 parts by weight of isobutyl methacrylate and 36 parts by weight of styrene to 10 parts by weight of the resin content of the dispersant were subjected to emulsion polymerization in the conventional manner to produce an aqueous resin dispersion C. This dispersion C had a solid content of 40 wt. % and a glass transition temperature of ca. 67° C.

Example 4

Preparation of Dispersion D

An aqueous alkaline solution of an alkali-soluble resin consisting of 29 wt. % of acrylic acid, 12 wt. % of styrene, 56 wt. % of α-methylstyrene and 3 wt. % of ethyl diglycol acrylate was used as the emulsifying agent and 20 parts by weight of styrene and 50 parts by weight of 2-ethylhexyl acrylate to 30 parts by weight of the resin content of the dispersant were subjected to emulsion polymerization to produce an aqueous resin dispersion D. The dispersion D so produced had a solid content of 45 wt. % and a glass transition temperature of ca. 40° C.

Examples 1 to 7 of the Coating Agents for Roll Press Working

Using the dispersions A to D produced in Examples 1 to 4, coating agents for roll press working 1 to 7 were prepared based on the formulations shown in Table 1.

The figures in the Table stand for parts by weight. Polyethylene wax was used as the wax and a phosphate type material was used as the mold release agent.

TABLE 1

| | Coating Agents dispersion | | | | | | |
|---|---|---|---|---|---|---|---|
| | 1 | 2 | 3 | 4 | 5 | 6 | 7 |
| Dispersions A | 80 | — | — | 60 | — | — | — |
| Dispersions B | — | 80 | — | — | — | — | — |
| Dispersions C | — | — | 80 | — | 80 | — | 80 |
| Dispersions D | — | — | — | 20 | — | 80 | — |
| silica gel *1 | — | — | — | — | 2.0 | — | 6.0 |
| ethanol | 10 | 10 | 10 | 10 | 10 | 10 | 7 |
| butyl carbitol | 5 | 5 | 5 | 5 | 5 | 5 | 5 |
| wax | 1 | 1 | 1 | 1 | 1 | 1 | 1 |
| mold release agent | 1 | 1 | 1 | 1 | 1 | 1 | 1 |
| water | 3.0 | 3.0 | 3.0 | 3.0 | 3.0 | 3.0 | — |

*1 "Syloid 63" prepared by Fuji Davison Co., Ltd. was used as the silica gel.

Examples 1 to 4 and Comparative Example 1

Using a web-fed coated paper (85 g/m$^2$; manufactured by Oji Seishi Co., Ltd.) as the printing paper, an aqueous flexographic ink in the first color unit and the aforementioned coating agents 1 to 4 and 6 in the second color unit on a Cobden's flexographic printer, printing and coating of the respective coating agents for roll press working were performed. Then, using only the roll press working unit portion of the system shown in FIG. 1, roll press working was performed at a rate of 80 m/min at a hot roll temperature of 150° C. and a pressure of 100 kg/cm$^2$ to impart a gloss. The degree of gloss of the portions with the coating agent superimposed on the printing ink after roll press working was measured with a gloss meter. The measured values are shown in Table 2.

In Comparative Example 1 in which coating agent 6 was used, the web was taken up after roll press working and was found to suffer from blocking and thus lack practical utility.

Examples 5 and 6

Using the same paper as in Example 1 as the printing paper, printing was performed with a solvent type gravure ink, and the printed paper was taken up. The same paper was printed with a web offset rotary printing ink and similarly taken up. These papers were installed on a roll stand of the type shown in FIG. 1, and coated by means of a coater with the coating agent 2. The roll press working was performed under the same conditions as in Example 1 to impart gloss to the printed paper.

The degree of gloss was similarly measured, the results being shown in Table 2.

Comparative Examples 2 and 3

The printed matter coated with the coating agent for roll press working employed in Examples 1 and 2 was employed without being roll press worked and the gloss achieved by solely coating with the coating agent was measured. The results are shown in Table 2.

Comparative Example 4

Printing and coating were performed under the same conditions except for use of the cast-coated paper of Example 1 as the printed matter. The results gloss measurement are shown in Table 2.

TABLE 2

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| | Coating agent | | | | | | | | | |
| | 1 | 2 | 3 | 4 | 2 | 2 | 6 | 1 | 2 | 1 |
| gloss | 83 | 94 | 89 | 83 | 90 | 90 | 86 | 55 | 61 | 51 |
| rub resistance | ○ | ○ | ○ | ○ | ○ | ○ | Δ | ○ | ○ | x |
| water resistance | ○ | ○ | ○ | ○ | ○ | ○ | ○ | ○ | ○ | Δ |
| folding resistance | ○ | ○ | ○ | ○ | ○ | ○ | ○ | ○ | ○ | x |

Each of the items of printed matter obtained in Examples 1 to 6 and Comparative Examples 1 to 4 was tested for rub resistance, water resistance and folding resistance. The results are shown in Table 2.

In Evaluation Test 1, evaluation was made in the following manner.

Rub Resistance

Each item of printed matter was tested 2,000 times under a load of 500 g on a vibration type rub resistance tester. Test-samples having sufficient resistance are marked ○ and those having insufficient resistance are marked ×.

Water Resistance

Using the same method as that for rub resistance but using a cloth soaked with water, rub resistance was tested 50 times under a load of 500 g. Test samples having sufficient water resistance are marked ○, those in which the cloth was contaminated slightly are marked Δ, and those in which the cloth was completely contaminated are marked ×.

Folding Resistance

The test samples were bent with the printed sides facing outwards. Those samples in which the printed sides thereof became cracked are marked × and those which remained unchanged are marked ○.

Comparative Example 6

The printed matter obtained upon application of the coating agent used in Example 1 was cut and roll press-worked using an endless press including a conventional stainless steel belt. The press working was performed at a speed of 25 m per minute, a temperature of 120° C. and a pressure of 100 kg/cm.

In some endless press working units, the printed matter could not be smoothly peeled off despite the fact that a cooling process was provided back of the hot roll and the operational efficiency was extremely low, requiring manual assistance. Thus efficient press working could not be performed on this endless press.

Examples 7 and 8

Using a web-coat ball paper (300 g/m$^2$; "Jet Star" manufactured by Daishowa Seishi Co., Ltd.) as the printing paper, an aqueous flexographic ink for the first color and the aforementioned coating agents 1 and 2 for the second color on a Cobden's flexographic printer, printing and coating of the respective coating agents for roll press working were performed. Then, using only the roll press working unit portion of the system shown in FIG. 1, roll press working was performed at a rate of 80 m/min at a hot roll temperature of 150° C. and a pressure of 100 kg/cm at a rate of 80 m/min to impart a gloss. The degree of gloss of the portions with the coating agent superimposed on the printing ink roll after press working was measured with a gloss meter. The measured values are shown in Table 3.

TABLE 3

| | Example | | | | Comparative Example | |
|---|---|---|---|---|---|---|
| | 7 | 8 | 9 | 10 | 5 | 6 |
| gloss | 85 | 96 | 93 | 95 | 55 | 61 |
| rub resistance | ○ | ○ | ○ | ○ | ○ | ○ |
| water resistance | ○ | ○ | ○ | ○ | ○ | ○ |
| folding resistance | ○ | ○ | ○ | ○ | ○ | ○ |

Examples 9 and 10, Comparatice Examples 5 and 6

The procedures of Examples 5 and 6 and Comparative Examples 2 and 3 were followed except for use of the coat ball paper of Example 7 to provide a gloss on the paper samples. The results were evaluated in the similar manner and are shown in Table 3.

Examples 11 to 15 and Comparative Examples 7 and 8

Using a two-color rotary flexo press for printing the corrugated board liner, an aqueous flexographic ink as the first color and the respective coating agents 1 to 7 as the second ink, printing and coating were performed continuously on a UF Manila paper (230 g/m$^2$) manufactured by Honshu Seishi Co., Ltd. After drying, the paper was roll press worked on the hot roll of a roll press unit like that shown in FIG. 2 at a temperature of 100° C., a linear pressure of 100 kg/cm and a speed of 60 m/minute to provide the paper with gloss. The gloss obtained following press working was measured by a gloss meter and the measured values are shown in Table 4.

The liner to which gloss had been imparted was mounted as a front liner on a mill stand roll for front liners and bonded to a core and back liner in a corrugating machine to produce a corrugated board.

The gloss of the board produced was measured similarly on a gloss meter to evaluate the gloss ratio after press working, that is, the degree to which the gloss deteriorated.

The occurrence of surface cracks caused by the corrugating machine and contamination by the hot plate was checked. The test samples which showed perfect results are marked ○, those which suffered from cracks or contamination to some extent but which were generally acceptable are marked Δ, and those which suffered severely from cracks or contaminations and were unacceptable are marked ×. The occurrence of blocking caused by stacking of the cut boards was also checked and the results are shown in Table 4.

TABLE 4

| | | Example | | | | | Comparative Example | |
|---|---|---|---|---|---|---|---|---|
| | | 11 | 12 | 13 | 14 | 15 | 7 | 8 |
| | | Coating agent | | | | | | |
| | | 1 | 2 | 3 | 4 | 5 | 6 | 7 |
| gloss | after press working | 83.9 | 94.8 | 89.3 | 82.9 | 83.9 | 86.5 | 62.8 |
| | gloss ratio ** | 0.97 | 0.90 | 0.91 | 0.94 | 0.96 | *** | 1.00 |

TABLE 4-continued

| | Example | | | | | Comparative Example | |
|---|---|---|---|---|---|---|---|
| | 11 | 12 | 13 | 14 | 15 | 7 | 8 |
| | Coating agent | | | | | | |
| | 1 | 2 | 3 | 4 | 5 | 6 | 7 |
| adaptability to corrugator, surface flaws, | ○ | ○ | ○ | ○ | ○ | x | ○ |
| hot plate contaminations | ○ | ○ | ○ | ○ | ○ | x | ○ |
| blocking resistance | good | good | good | good | good | poor | good |

** The gloss ratio is given by the gloss value displayed after passage through the corrugating machine divided by the gloss ratio exhibited after press working.
*** In Comparative Example 1, numerous cracks were formed on the surface and gloss values could not be measured.

Example 16

Using a two-color rotary flexo press for printing of a corrugated board liner as in Example 1, printing was performed on a UF Manila paper manufactured by Honshu Seishi Co., Ltd. (230 g/m$^2$) with an aqueous flexographic ink, and the printed front liner was taken up. The pre-printed front liner was mounted on a mill roll stand for front liners of an improved corrugating machine arranged as shown in FIG. 1. Using a coater having a gravure roll and the coating agent 5, coating was performed in a corrugating machine. After drying in a preheater, the front liner was provided with gloss by a roll press working unit having three pairs of press rolls and bonded to a core and a back liner in a double facer section to produce a printed and roll press-worked corrugated board. The board so produced showed high gloss as in Example 5 and was free of cracking and hot-plate contamination.

As described above, according to the process of the present invention, printed matter having high gloss and resistance may be obtained efficiently and economically even in the case of a thin light weight paper.

With use of the device disclosed in the present invention, the process of coating the coating agent for roll press working and of press working can be performed continuously and efficiently, inclusive of the printing process.

When the method of the present invention is applied to the manufacture of corrugated boards, a printed corrugated board having high gloss can be produced extremely efficiently. What's more, by using a specified coating agent for roll press working, corrugated boards with a hgih gloss can be produced that are free from any risk of deterioration of the gloss quality, surface cracking and hot-plate con-tamination even after passing through the bonding process employed in a corrugating machine adapted for producing corrugated boards.

The adaptability to processing in corrugating machines can also be improved by incorporating inorganic fillers in a specified range in the aqueous resin dispersion which is used as the coating agent for roll press working in cases where the dispersion has a lower Tg.

On the other hand, coating agents applied in an aqueous resin dispersion having a low Tg showed no adaptability to the processing in the corrugating machine and are thus unsuitable for the manufacture of corrugated boards.

It will be noted that printed matter obtained by application of the method of the present invention shows improved water resistance and provides cartons or pouches of improved strength, in addition to showing improved gloss characteristics.

What is claimed is:

1. A method of producing glossy printed matter having a mirror surface glossiness as well as improved blocking resistance, rub resistance and folding resistance, comprising the steps of:

printing a web printing paper with a printing ink to provide a web-fed printed matter;

applying a coating agent for roll press working consisting essentially of an aqueous resin dispersion having a glass transition temperature, $T_g$ ranging from 60° to 130° C. to said web-fed printed matter, said aqueous resin dispersion being obtained by emulsion polymerization of vinyl monomers selected from an acrylic vinyl monomer and a styrenic monomer as a main component in an amount weighing 16 times or more than that of an inorganic filler, with the inorganic filler comprising no more than 5.0 wt. % of the total wt. of the coating agent; and bringing said printed and coated web-fed matter in the web state into intimate contact with hot roll surface of a roll press machine having at least one hot roll machined to a mirror finish at a temperature of from 90° to 150° C. at a linear pressure of from 60 to 150 kg/cm.

2. The method in claim 1 wherein said printed and coated web-fed matter is pressed onto the hot roll by a first pressure roll which is facing in front of said hot roll so as to be pressed by the mirror surface of the hot roll and said printed and coated web-fed matter is guided by a dancing roll, which is positioned below the hot roll, and then said printed and coated web-fed matter is pressed into the hot roll by a second pressure roll and cooled by a cooling roll.

3. The method according to claim 1 wherein the printing, coating and roll press-working steps are executed continuously or non-continuously.

4. A method of producing glossy printed corrugated board having a mirror surface glossiness as well as improved blocking resistance, rub resistance, folding resistance and adaptability to corrugator comprising the steps of:

printing a web printing paper with a printing ink to provide a web-fed printed matter;

applying a coating agent for roll press working consisting essentially of an aqueous resin dispersion having a glass transition temperature, $T_g$ ranging 60° to 130° C. to said web-fed printed matter, said aqueous resin dispersion being obtained by emulsion polymerization of vinyl monomers selected from an acrylic monomer and a styrenic monomer as a main component in an amount weighing 16 times or more than that of an inorganic filler comprising no more than 5.0 wt. % of the total wt. of the coating agent;

bringing said printed and coated web-fed matter in the web state into intimate contact with a hot roll surface of a roll press working machine having at least one hot roll machined to a mirror finish at a temperature of from 90° to 150° C. at a linear pressure of from to 150 kg/cm; and bonding a core and back liner to the printed and coated matter as a front liner in a corrugator machine.

5. A method according to claim 4, wherein said printed and coated web-fed matter is pressed onto the hot roll by a first pressure roll which is facing in front of said hot roll by a first pressure roll so as to be pressed by the mirror surface of the hot roll, and after an elongation of said printed and coated web-fed matter associated with the pressing onto the hot roll it is taken up by a dancing roll, which is positioned below the hot roll, and then said printed and coated web-fed matter is pressed into the hot roll by a second pressure roll and cooled by a cooling roll.

* * * * *

UNITED STATES PATENT AND TRADEMARK OFFICE

CERTIFICATE OF CORRECTION

PATENT NO. : 5,368,891
DATED : November 29, 1994
INVENTOR(S) : Sagara et al.

It is certified that error appears in the above-indentified patent and that said Letters Patent is hereby corrected as shown below:

Claim 4, Column 16, line 24, between "from" and "to" insert --60--.

Signed and Sealed this

Fourth Day of April, 1995

Bruce Lehman

*Attest:*

BRUCE LEHMAN

*Attesting Officer*

*Commissioner of Patents and Trademarks*